US005273098A

United States Patent [19]

Hyndman et al.

[11] Patent Number: 5,273,098

[45] Date of Patent: Dec. 28, 1993

[54] REMOVABLE CORES FOR METAL CASTINGS

[75] Inventors: Christopher P. Hyndman; Robert A. Wordsworth, both of Rugby, United Kingdom

[73] Assignee: AE Piston Products Limited, West Yorkshire, England

[21] Appl. No.: 833,790

[22] Filed: Feb. 12, 1992

[30] Foreign Application Priority Data

Feb. 28, 1991 [GB] United Kingdom ..... 9104179

[51] Int. Cl.[5] ..... B22C 1/00; B22C 9/10

[52] U.S. Cl. ..... 164/15; 164/522

[58] Field of Search ..... 164/522, 523, 6, 15

[56] References Cited

U.S. PATENT DOCUMENTS

| | | | |
|---|---|---|---|
| 3,356,129 | 12/1967 | Anderko et al. | 164/138 |
| 4,093,017 | 6/1978 | Miller, Jr. et al. | 164/520 |
| 4,097,291 | 6/1978 | Huseby et al. | 106/38.9 |
| 4,370,436 | 1/1983 | Nakamura et al. | 264/117 |
| 4,480,681 | 11/1984 | Alexander et al. | 164/522 |
| 4,711,669 | 12/1987 | Paul et al. | 164/521 |
| 4,840,219 | 6/1989 | Foreman | 164/522 |
| 5,091,344 | 2/1992 | Enomoto et al. | 264/60 |

FOREIGN PATENT DOCUMENTS

| | | | |
|---|---|---|---|
| 0127367 | 12/1984 | European Pat. Off. . | |
| 1302940 | 3/1971 | Fed. Rep. of Germany . | |
| 0188541 | 11/1983 | Japan | 164/15 |
| 60-118350 | 6/1985 | Japan . | |
| WO85/04605 | 10/1985 | PCT Int'l Appl. . | |
| 2105312A | 3/1983 | United Kingdom . | |

OTHER PUBLICATIONS

Metals Handbook, 8th Ed., vol. 4, 1969, p. 450.
Metals Handbook, vol. 7, 1984.

*Primary Examiner*—Richard K. Seidel
*Assistant Examiner*—Erik R. Puknys
*Attorney, Agent, or Firm*—Nixon & Vanderhye

[57] ABSTRACT

A method for the manufacture of salt cores is described. The cores are used for the production of cavities in articles which have been made by a pressure casting technique. The cores are resistant to impregnation and fracture during, for example, the application of pressure during squeeze casting. In particular, the method comprises mixing coarse and fine particle salt powders in the ratio from 50/50 to 70/30 coarse/fine, the coarse powder having a maximum particle size of 250 micrometers, the fine powder having a maximum particle size of 25 micrometers. A lubricant, for example, oleic acid is added, possibly the quantity thereof being in the range 0. 1 to 1.0 wt %. A surfactant, such as a silane, also may be added, possibly the quantity thereof being in the range 0.1 to 1.0 wt %. The mixture is pressed to form a core having a density of at least 1.90 g/cm$^3$; and is sintered at a temperature between 650° C. and 775° C., for a time in the range 15 minutes to 1 hour.

20 Claims, 2 Drawing Sheets

REMOVABLE CORES FOR METAL CASTINGS

Figure 1:
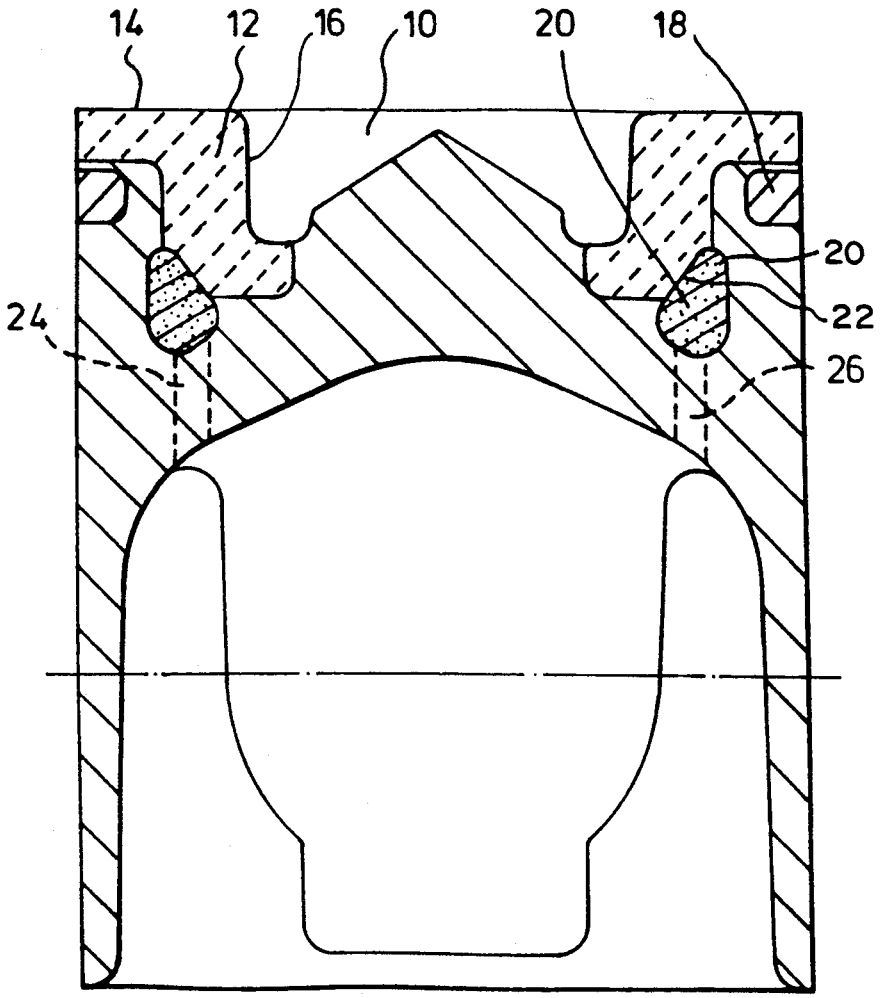

The present invention relates to removable cores for metal castings and particularly, though not exclusively, to cores able to withstand impregnation by molten metal during pressure casting such as, for example, by squeeze-casting.

It is necessary in some instances to be able to produce cavities within cast articles. In the case of gravity cast aluminium alloys, for example, a shaped core of hardened sand or salt is placed within the mould and molten metal poured to fill the mould and surround the core. Surface tension effects between the molten metal and core prevent impregnation of the metal into the porosity contained in the core. Where salt cores are used, it is usual to drill into the cored cavity so formed and flush out the core with water to leave a clear, unobstructed cavity.

Where aluminium alloy internal combustion engine pistons are concerned, it is sometimes necessary to include a cavity in the crown region to form, for example, a generally annular oil cooling gallery. Where such pistons are gravity cast, the existing salt core technology is adequate. However, in order to improve the properties of aluminium alloy pistons, particularly for use in highly rated diesel engines, some manufacturers have turned to pressure casting of pistons. One pressure casting technique, particularly suited to the manufacture of pistons, is that known as squeeze casting. In squeeze casting, a measured quantity of molten metal is poured into the female portion of a permanent die which is then closed with a moveable male die punch member to which may be applied a pressure of up to about 150 MPa or more, which pressure is generally maintained throughout solidification of the metal in the die. The effect of this casting technique is to produce a piston, or any other article, which is substantially free of porosity.

The problem with known cores is that they are too porous to resist penetration by the pressurised molten metal. In an enclosed oil gallery this may mean that membranes of solid metal may extend across the gallery, thereby preventing the flow of cooling oil. Attempts have been made to increase the density of salt cores by using higher pressing pressures on the salt powder. However, these attempts have resulted, in some cases, in reduced metal penetration due to higher densities (less porosity) but the cores so produced have generally always fractured on application of the squeeze pressure. Where such fracture occurs, metal is impregnated into the fracture surfaces. Because of the inaccessibility of oil cooling galleries, it is essential that a core be resistant to metal penetration and to fracture.

GB 2 156 720 describes the use of salt cores formed by isostatic pressing of the salt powder and which are used to form a shaped combustion chamber on the crown external surface in a squeeze-casting production method. In this case any metal residue remaining due to penetration of the core by the pressurised molten metal is easily removed because of the free access available in the open combustion chamber after the core has been flushed out. Generally, cores used for casting combustion chambers to shape are relatively large in section, strong, and therefore, inherently resistant to fracture. Cooling gallery cores, on the other hand, are of relatively thin section and more fragile in nature. Cooling gallery cores made of isostatically pressed salt have also regularly been penetrated and fractured. Furthermore, isostatic pressing is not a viable technique for the production of oil gallery cores because of the greatly increased cost of producing a relatively complex shaped item in contrast to the relatively simple shape of a combustion bowl insert.

It is an object of the present invention to provide a salt core which is both resistant to penetration by molten metal and resistant to fracture under the effect of pressure during squeeze-casting.

According to the present invention there is provided a method for the manufacture of a salt core for the production of a cavity in a pressure cast article, the method comprising the steps of mixing coarse and fine particle salt powders in the ratio from 50/50 to 70/30 coarse/fine, the coarse powder having a maximum particle size of 250 micrometers, the fine powder having a maximum particle size of 25 micrometers, adding a lubricant, pressing the mixture to form a desired core shape and sintering at a temperature between 650° C. and 775° C.

In one embodiment of the method, the lubricant comprises oleic acid, and is preferably present in an amount from 0.1 wt % to 1.0 wt % and more preferably in an amount from 0.2 wt % to 0.7 wt %. It has been found that this material allows greater densities to be attained for any given pressing pressure.

In a preferred embodiment of the method of the present invention, the mixture also contains a surfactant. The surfactant may in one embodiment of the method comprise a silane, and may preferably be present in an amount from 0.1 wt % to 1.0 wt % and more preferably from 0.2 wt % to 0.7 wt %. The surfactant improves the flowability or die filling capability of the powder mixture which tends to be impaired by the lubricant. It should be emphasized that although the above quantities appear to be optimum for silane, this may not be the case for other surfactants. The criteria should be that the surfactant renders the mixed salt powder handlable and flowable and does not significantly detract from the final sintered strength.

Annular cores for the purpose of forming an oil cooling gallery may conveniently be formed by die-pressing at pressures up to about 180 MPa. The use of a lubricant additive such as oleic acid renders such pressures feasible without binding or seizing of the die members. If desired, isostatic pressing may be used in appropriate circumstances where similar pressures will be found to be adequate. It has been found in practice that pressures in the range from 75 to 150 MPa produce cores which, after sintering, are resistant to molten metal penetration at squeeze pressures up to about 150 MPa or more, and are also resistant to fracture.

The sintering temperature may lie in the range from 650° C. to 775° C. Below the minimum temperature, it has been found that insufficient strength is generated whilst above the maximum temperature it has been found that excessive grain growth adversely affects strength. In practice, a temperature of about 750° C. has been found to give good results when a sintering time of about 30 minutes is employed. The sintering time may lie in the range from about 15 mins to 1 hour.

According to another aspect the present invention comprises a salt core manufactured in accordance with a method referred to above.

Preferably, the density of the sintered salt core should be at least 1.90 g/cm to resist impregnation at casting pressures of about 150 MPa.

Such a salt core as described above should have a minimum flexure strength of 25 MPa under test conditions to be described below.

In order that the present invention may be more fully understood, examples will now be described by way of illustration only.

Figure 2A:
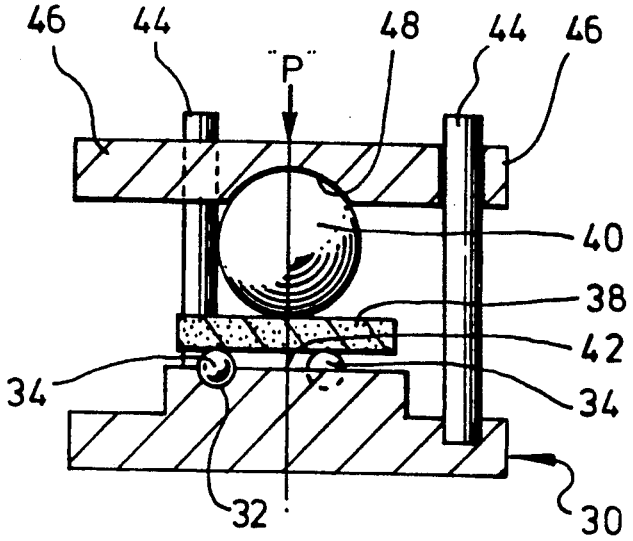
Figure 2B:
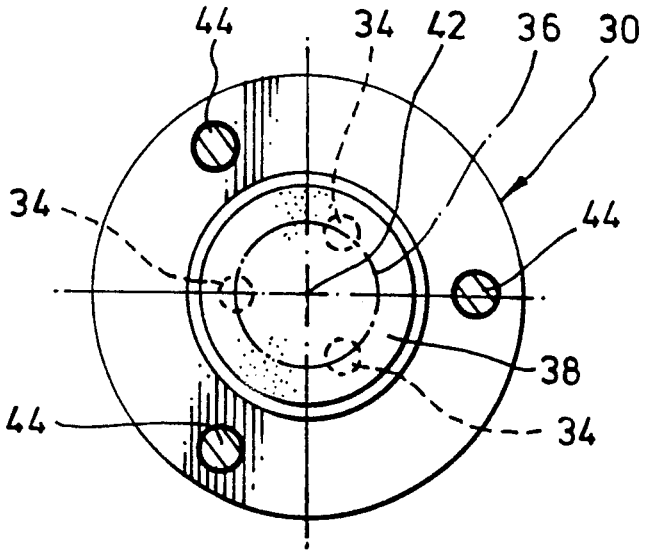

The accompanying drawings comprise:

FIG. 1 showing a seek-ion through a piston having an oil cooling gallery in the crown region and a combustion bowl;

FIGS. 2*a* showing a section in elevation of a testing jig to determine the flexure strength of a processed salt sample, and FIG. 2*b* comprising a plan view of the processed salt sample on the base part of the testing jig.

Referring now to FIG. 1 which shows a squeeze cast aluminium alloy piston having a shaped combustion bowl 10, an impregnated ceramic fibre reinforcement 12 on the crown surface 14 and on the bowl sides 16, an austenitic cast/iron piston ring groove reinforcement 18 and a soluble salt core 20, encast within the crown region. The piston is produced by supporting the core 20 on the underside 22 of the reinforcement 12 and casting the piston in the "crown-down" mode, that is with the piston crown being formed in the bottom of the casting die (not shown). The core is removed through drilled holes 24, 26 (shown as dashed lines) into which water is directed to dissolve and flush out the core. Once removed, an oil cooling chamber remains into which, in service, oil is directed from, for example, a standing jet in the engine crankcase. It will be immediately apparent that there is little or no access to this chamber by conventional machine tools. Therefore, if the core becomes impregnated with metal during squeeze casting a "web" or "net" of metal will be left behind after core removal. Such a web or net is difficult and expensive to remove and, if left, will severely restrict the flow of oil around the gallery so formed, thereby impeding efficient cooling. Similarly, if the core 12 has insufficient strength and fractures under the squeeze pressure, as may happen due to differential solidification or uneven support, then a metal membrane will be formed by penetration of the fracture and completely block the gallery to the flow of oil.

The core 20 was formed by making a mixture comprising 60 wt % of a coarse salt fraction having a maximum particle size distribution of 250 micrometers with 40 wt % of fine salt having a maximum particle size of 25 micrometers. To this mixture was added 0.5% of oleic acid, as a powder particle lubricant, and 0.5% of a silane surfactant, to aid flowability of the powder mixture into the pressing die. The salt core was pressed at a pressure of 86.5 MPa to give a pressed density of 1.916 g/cm$^3$. The pressed core was then sintered for 30 minutes at 750° C. to give a sintered density of 1.955 g/cm$^3$. The strength of the as-pressed material was 15.3 MPa whereas the strength of the sintered material was 54 MPa.

Strength was measured by a disc flexure technique using the testing jig shown in FIGS. 2*a* and 2*b*. The jig comprises a base 30 having three recesses 32 which locate and retain three steel balls 34 equi-angularly spaced on a pitch circle 36 of diameter 15.6 mm. The salt specimen to be tested, in the form of a flat disc 38, rests on the balls 34. A steel ball 40 of 19.04 mm diameter rests on top of the salt disc 38 over the centre 42 of the circle 36. Located in the base 30 are three vertical pillars 44 which guide a sliding top plate 46 having a central recess 48 which maintains the ball 40 over the centre 42. A force "P" is applied to the plate 46 until fracture of the disc 38 occurs.

The salt core produced by the above method was found to produce an impervious and fracture resistant core at the squeeze casting pressure to be used, which was 155 MPa. It has been found that cores having a density of less than 1.90 g/cm$^3$ are not resistant to impregnation at squeeze casting pressures of 150 MPa and above.

The following Table shows the variation in density and strength achieved with various mixtures and pressing pressures.

TABLE 1

| Additive Composition | Pressing Pressure MPa | Density (g/cm$^3$) Pressed | Density (g/cm$^3$) Sintered | Flexure Strength (MPa) Pressed | Flexure Strength (MPa) Sintered |
|---|---|---|---|---|---|
| None | 62* | 1.860 | 1.880 | 29.2 | 59.6 |
| 1% Oleic Acid | 62 | 1.901 | 1.902 | 12.0 | 46.8 |
| 1% Oleic Acid | 86 | 1.969 | | | |
| 0.5% Oleic Acid | 86 | 1.824 | 1.850 | 6.3 | 47.0 |
| 1% Silane | 62 | 1.825 | 1.881 | 26.7 | 56.3 |
| 1% Silane | 94* | 1.900 | | | |
| 1% OA 1% Sil. | 86 | 1.933 | | | |
| 0.5% OA & 0.5% Sil | 86 | 1.916 | 1.955 | 15.3 | 54.0 |
| 0.5% OA & 0.5% Sil | 124 | 1.963 | 1.987 | 24.5 | 58.5 |
| .25% OA & .25% Sil | 86 | 1.901 | 1.933 | | 46.5 |
| .25% OA & .25% Sil | 124 | 1.956 | 1.972 | | 58.1 |

Salt Composition: 60 wt % coarse and 40 wt % fine,
Sintering Schedule: 700 C. for 0.5 hours,
@ Sintering schedule: 750 C. for 0.5 hours,
*Maximum pressure that could be realised with these powders,
$ repeat test,
Specimen Size: 32 mm diameter and 3 mm thick, area 804 mm$^2$,
Sil = Silane,
OA = Oleic acid.

We claim:

1. A method for the manufacture of a salt core for the production of a cavity in an article formed by an pressure casting process such that the core is of sufficient strength and density to withstanding casting pressures, the method comprising the steps of mixing coarse and fine particle salt powders in the ratio from 50/50 to 70/30 coarse/fine, the coarse powder having a maximum particle size of 250 micrometers, the fine powder having a maximum particle size of 25 micrometers; adding a lubricant; pressing the mixture to form a core of desired shape; and sintering the core at a temperature between 650° C. and 775° C., so that the core has a density of at least 1.90 g/cm$^3$ and a minimum flexure strength of 25 MPa.

2. A method according to claim 1 wherein the lubricant comprises oleic acid.

3. A method according to claim 1 wherein the core pressing pressure is in the range 75 to 150 MPa.

4. A method for the manufacture of a salt core for the production of a cavity in a pressure cast article, the method comprising the steps of mixing coarse and fine particle salt powders in the ratio from 50/50 to 70/30 coarse/fine, the coarse powder having a maximum particle size of 250 micrometers, the fine powder having a maximum particle size of 25 micrometers; adding a lubricant and a surfactant, the surfactant added to aid flowability of the mixture; pressing the mixture to form a core of desired shape, and sintering the core at a temperature between 650° C. and 775° C., so that the core has a density of at least 1.90 g/cm$^3$ and a minimum flexure strength of 25 MPa.

5. A method according to claim 4 wherein the lubricant comprises oleic acid.

6. A method according to claim 5 wherein the quantity of oleic acid is from 0.1 wt % to 1.0 wt %.

7. A method according to claim 6 wherein the quantity of oleic acid is from 0.2 wt % to 0.7 wt %.

8. A method according to claim 4 wherein the surfactant comprises a silane.

9. A method according to claim 8 wherein the quantity of a silane is from 0.1 wt % to 1.0 wt %.

10. A method according to claim 9 wherein the quantity of a silane is from 0.2 wt % to 0.7 wt %.

11. A method according to claim 4 wherein the core pressing pressure is in the range 75 to 150 MPa.

12. A method for the manufacture of a salt core for the production of a cavity in a pressure cast article, the method comprising the steps of mixing coarse and fine particle salt powders in the ration from 50/50 to 70/30 coarse/fine, the coarse powder having a maximum particle size of 250 micrometers, the fine powder having a maximum particle size of 25 micrometers, adding a lubricant comprising oleic acid, and adding a surfactant comprising a silane, pressing the mixture to form a core of desired shape, and sintering the core at a temperature between 650° C. and 775° C., so that the core has a density of at least 1.90 g/cm$^3$ and a minimum flexure strength of 25 MPa.

13. A method according to claim 12 wherein the quantity of oleic acid, and the quantity of a silane, each is from 0.1 wt % to 1.0 wt %.

14. A method according to claim 13 wherein the quantity of oleic acid, and the quantity of a silane, each is from 0.2 wt % to 0.7 wt %.

15. A method according to claim 12 wherein the core pressing pressure is in the range 75 to 150 MPa.

16. A method of manufacturing a salt core for the production of a cavity in an article formed by pressure casting under squeeze pressures of up to about 150 MPa, the method comprising the steps of;

a) forming a mixture of coarse and fine particle salt powders in a ratio from 50/50 to 70/30 coarse/fine, the coarse powder having a maximum particle size of 250 micrometers and the fine powder having a maximum particle size of 25 micrometers;

b) adding 0.5 wt % of oleic acid as a lubricant to enable increased density to be attained;

c) adding 0.5 wt % of a silane as a surfactant to improve flowability of the mixture;

d) pressing the mixture to form a core of desired shape; and e) sintering the mixture at a temperature of between 650° C. and 775° C., so that the core has a density of at least 1.90 g/cm$^3$ and a minimum flexure strength of 25 MPa.

17. The method of claim 16 wherein step d) is carried out at a pressing pressure of 86 MPa.

18. The method of claim 16 wherein step d) is carried out at a pressing pressure of 124 MPa.

19. The method of claim 16 wherein step e) is carried out for 0.5 hour.

20. The method of claim 16 wherein the ratio of coarse to fine particles is 60/40.

* * * * *